United States Patent [19]

Church

[11] 4,358,860

[45] Nov. 16, 1982

[54] AUTOMATIC ACTUATOR FOR AIR FRESHENER DISPENSER OR THE LIKE FOR TOILETS

[75] Inventor: David R. Church, Wyoming, Mich.

[73] Assignee: Amway Corporation, Grand Rapids, Mich.

[21] Appl. No.: 240,996

[22] Filed: Mar. 5, 1981

[51] Int. Cl.[3] ..... E03D 9/02

[52] U.S. Cl. ..... 4/228; 4/222; 4/227; 222/402.13; 222/402.15

[58] Field of Search ..... 4/222, 228, 227, 224; 222/57, 402.2, 402.13, 402.15, 380

[56] References Cited

U.S. PATENT DOCUMENTS

| | | | |
|---|---|---|---|
| 3,023,427 | 3/1962 | Behringer | 4/228 |
| 3,093,835 | 6/1963 | Kaplan | 4/228 |
| 3,914,805 | 10/1975 | Dolan | 4/228 X |
| 3,972,447 | 8/1976 | Fegley | 222/402.15 X |
| 3,999,226 | 12/1976 | Wolf | 4/227 X |
| 4,064,573 | 12/1977 | Calderone | 4/228 X |
| 4,168,550 | 9/1979 | Lindauer | 4/228 |

*Primary Examiner*—Henry K. Artis

*Attorney, Agent, or Firm*—Price, Heneveld, Huizenga & Cooper

[57] ABSTRACT

The specification discloses an automatic actuator for dispensers for air fresheners and the like mounted on the interior of a toilet tank, comprising an actuator arm having one end connected with the neck of the container, and extending generally laterally therefrom. A flexible tube communicates the outlet of the container with the exterior of the toilet tank. A pull rod is pivotally suspended from the actuator arm, and includes a valve head attached to the lower end of the rod. A cup has a valve seat located in the upper end thereof, in which the valve head is matingly received for selective reciprocation. The cup rises and descends, and suddenly empties during descent, with fluctuations in the water level of the toilet tank, thereby pivoting the actuator arm and neck to automatically dispense a predetermined amount of air freshener from the container with each flush of the toilet, and upon emptying, suddenly unweighting the dispenser valve to allow it to close.

18 Claims, 8 Drawing Figures

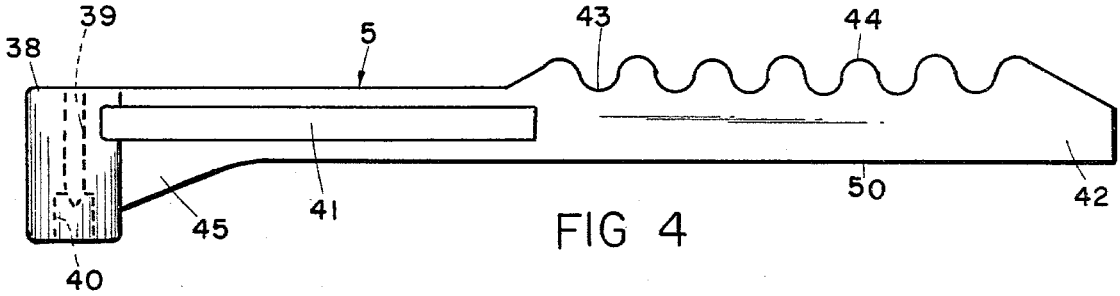
FIG 4
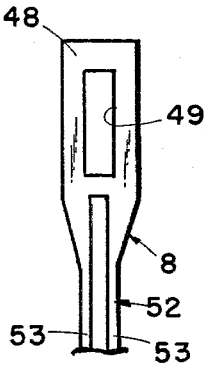
FIG 5
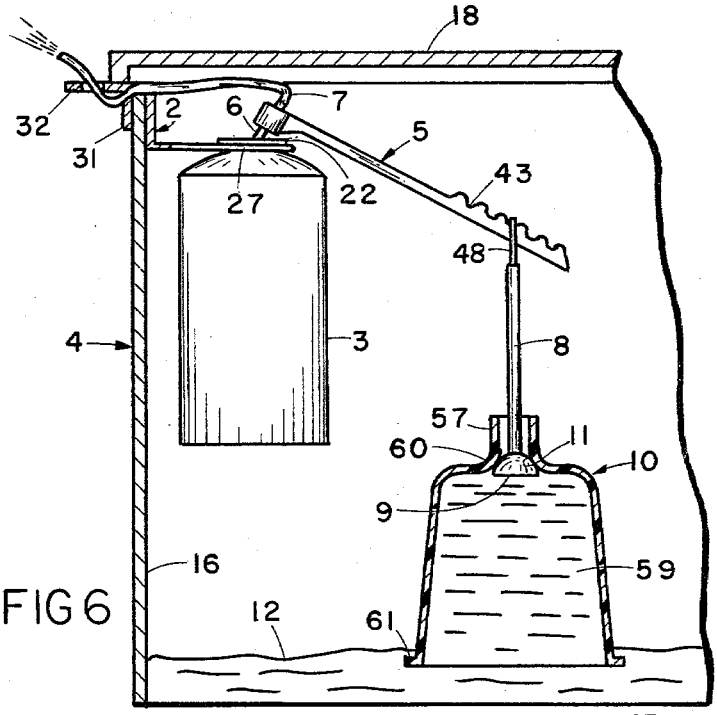
FIG 6
FIG 7
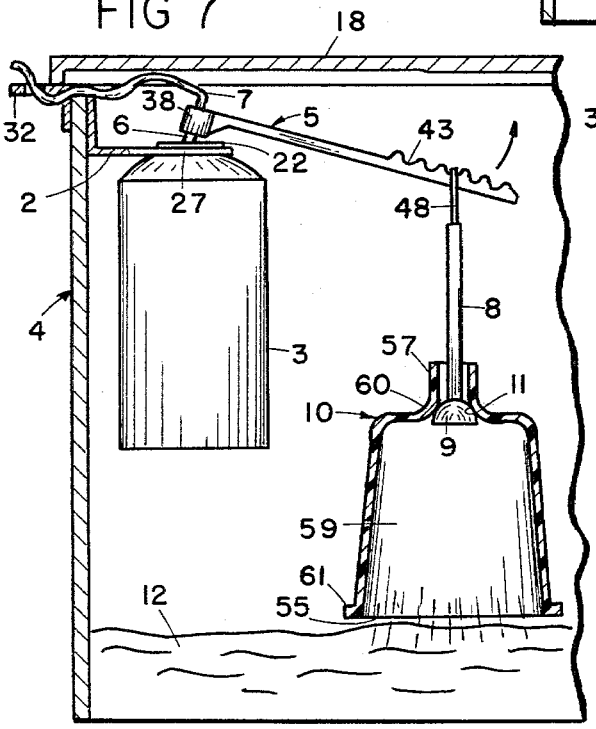
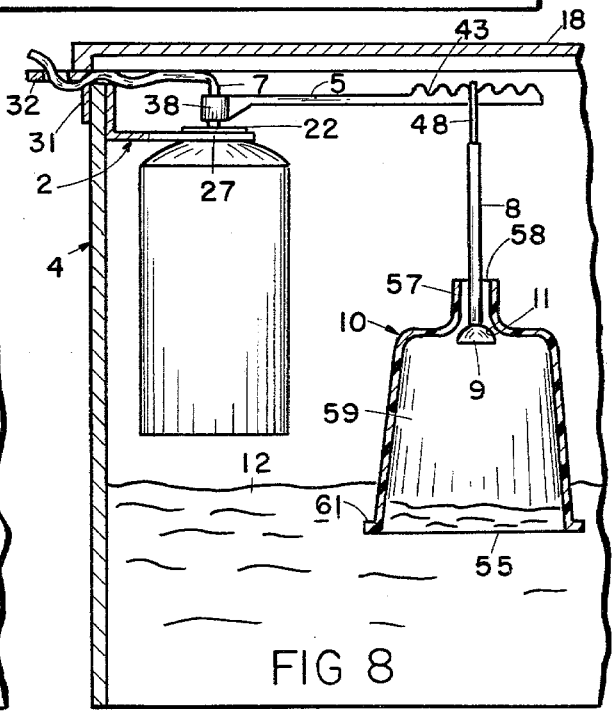
FIG 8

AUTOMATIC ACTUATOR FOR AIR FRESHENER DISPENSER OR THE LIKE FOR TOILETS

BACKGROUND OF THE INVENTION

The present invention relates to automatic actuators for toilet mounted dispensers, and in particular to an automatic air freshener dispenser for toilets and other similar water closets.

Automatic dispensers for spray air fresheners, sanitizers, and the like, have been developed for flush toilets. One example of an aerosol dispenser is disclosed in U.S. Pat. No. 4,064,573 to Calderone. Such devices have a tendency to be somewhat unreliable, because the force required to open the aerosol container valve is rather substantial, and the valve will often fail to close completely when the energizing force which is holding the valve open is removed very slowly. The constant weight of the dispenser on a standard plastic valve stem can distort the shape of the stem, and cause the stem and valve to take a set. As a result, the dispenser will sometimes not dispense air freshener when the toilet is flushed. Further, the aerosol container valve will sometimes leak, such that a constant spray of air freshener is dispersed from the aerosol container into the room. Although some devices, such as the Calderone mechanism noted above, are provided with a special valve arrangement to avoid leaking problems, they are quite complex, expensive, and preclude the use of conventional aerosol spray cans.

Another problem experienced with prior dispensers is that they do not provide any means for adjusting the amount of spray dispersed from the unit during each flush. Since the preference of consumers varies widely on the amount of air freshener desired for a particular room, and also depends upon room ventilation, the particular fragrance being dispersed, and other such factors, control over the amount of spray released during each cycle is very important to the commercial practicality of the device.

Yet another problem encountered with prior devices concerns their rather large, complex body design which is not only expensive, but can also interfere with the float, valve, and other working parts of the toilet. These types of dispensers are not particularly adapted to be easily adjusted so as to avoid interference with the toilet plumbing in the tank.

SUMMARY OF THE INVENTION

The present invention comprises an actuator for product dispensers such as aerosol air freshener containers and the like, which cleverly utilizes the changing water level in the water closet tank to first weight the aerosol valve and then almost instantly unweight it. An actuator arm has one end thereof shaped for connection with the product release mechanism of a container, such as the valve stem of an aerosol container, and extends generally laterally therefrom. A pull rod has its upper end suspended from the actuator arm, and includes a valve attached to the lower end of the rod. A cup is provided with an open lower end, and a closed upper end with a valve seat therein in which the pull rod valve is matingly received and selectively reciprocates, whereby the metering cup rises and fills with water as the water rises in the tank, then descends and then suddenly empties with descending water in the toilet tank to selectively pivot the actuator arm and automatically disperse a predetermined amount of air freshener with each toilet flush.

Preferably, the free end of the actuator arm includes detents for releasably connecting the pull rod at different locations along the length of the actuator arm to vary the amount of air freshener dispensed with each toilet flush. The pull rod valve has a semi-spherical shape to facilitate sealing, even when the pull rod is not exactly aligned with the metering cup.

The actuator arm is quite lightweight, and the cup buoyant, so that they do not apply sufficient force to the valve and/or valve stem to distort the shape of the same. As the water level in the toilet tank rises, air trapped in the cup is exhausted through the valve, and the cup is filled with water such that the spring return of the valve stem maintains the actuator arm in the closed aerosol valve position. As the water level in the toilet tank descends, the weight of the water trapped in the unbuoyed portion of the cup overcomes the valve stem return spring, and pivots the actuator arm into the open aerosol valve position until the descending water level drops below the lower edge of the cup, at which point the water trapped in the cup is released suddenly into the toilet tank, thereby quickly releasing the weight applied to the actuator arm, and permitting the valve stem return spring to swiftly pivot the actuator arm back into the closed aerosol valve position.

These and other advantages of the present invention will be further understood and appreciated by those skilled in the art by reference to the following written specification, claims and appended drawings.

BRIEF DESCRIPTION OF THE DRAWINGS

Fig. 4 is an enlarged, side elevational view of the actuator arm portion of the dispenser.

FIG. 5 is an enlarged, fragmentary, elevational view of the upper end of a pull rod portion of the dispenser.

FIG. 6 is a fragmentary, vertical cross-sectional view of the toilet, showing the dispenser in an activated condition.

FIG. 7 is a fragmentary, vertical cross-sectional view of the toilet, showing the water trapped in the metering cup being released into the tank to close the aerosol container valve.

FIG. 8 is a fragmentary, vertical cross-sectional view of the toilet, showing air trapped in the metering cup being exhausted therefrom as the water in the tank rises to the full level.

DETAILED DESCRIPTION OF THE PREFERRED EMBODIMENTS

Figure 1:
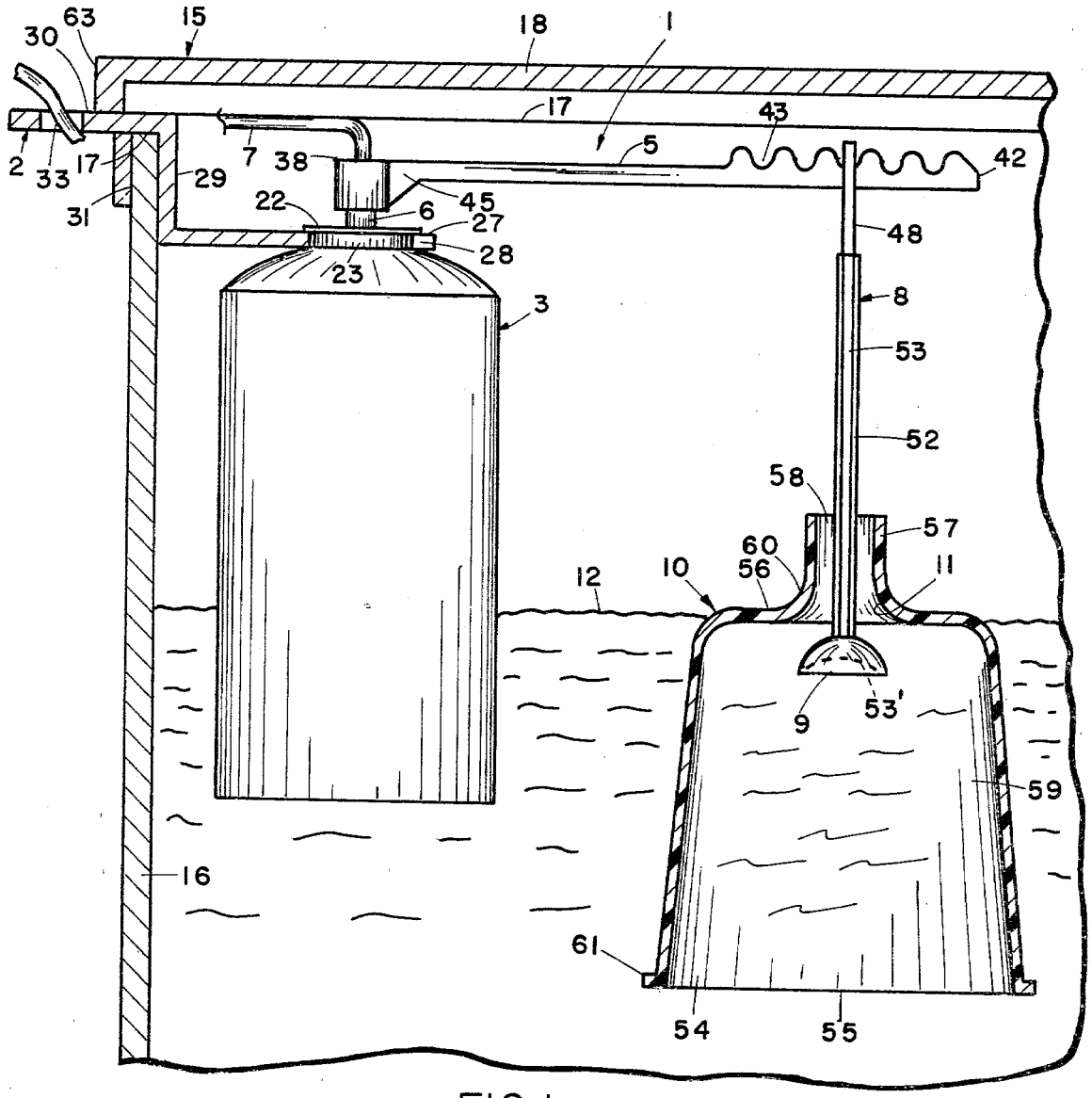
FIG. 1 is a side elevational view of a dispenser embodying the present invention, with portions thereof broken away to reveal internal construction, and shown attached to an aerosol air freshener container and mounted in a toilet tank.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

The reference numeral 1 (FIG. 1) generally designates an automatic spray dispenser assembly for air fresheners, sanitizers, or the like, including a bracket 2 mounting aerosol container 3 in the interior of a flush-type toilet tank 4. Dispenser 1 is particularly adapted for use in conjunction with aerosol sprays, and may also conceivably be used with pump-type sprays, as described in greater detail hereinafter. In the first example, an actuator arm 5 has one end connected with the valve stem 6 of aerosol container 3, and extends generally laterally therefrom. A flexible tube 7 communicates the outlet of aerosol container 3 with the exterior of tank 4. A pull rod 8 is pivotally or otherwise suspended from actuator arm 5, and includes a valve 9 mounted on the lower end of rod 8. A metering cup 10 has a valve seat 11 disposed in the upper end thereof in which valve 9 is matingly received and selectively reciprocates. Metering cup 10 rises and descends with fluctuations in the water level 12 of toilet tank 4 to pivot actuator arm 5 and valve stem 6 thereby automatically dispensing a predetermined amount of air freshener with each flush of the toilet.

Dispenser 1 is designed to be used in conjunction with virtually all types of conventional, flush toilets and water closets, such as the illustrated toilet 15, comprising tank sidewalls 16 having an upper edge 17 normally closed by a top 18. Toilet 15 also includes a standard float actuated water supply valve and flush handle (not shown). However, it is to be understood that dispenser 1 is also adapted to be used with non-float actuated water supply valves as well.

Figure 2:
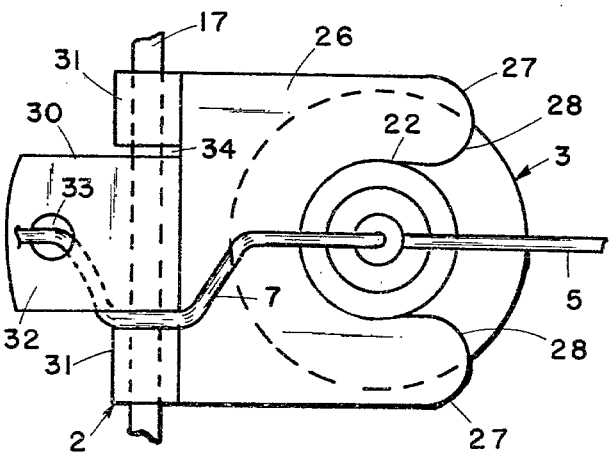
FIG. 2 is a top plan view of the dispenser and aerosol container.

As best shown in FIGS. 1 and 2, the present apparatus is designed to dispense air fresheners, sanitizers, and other similar sprays from a conventional aerosol container 3. Container 3 includes a rim 22 at the upper end or valve cup portion of the container, and is spaced slightly upwardly from the adjacent can portion to form an annularly shaped groove 23. Aerosol container 3 has a conventional valve construction, wherein valve stem 6 is resiliently retained in a normally closed, vertical orientation. Either vertical reciprocation or lateral pivoting of valve stem 6 causes the valve to open, thereby releasing air freshener from canister 3. In this embodiment, the upper end of valve stem 6 is the outlet through which the air freshener is released into flexible tube 7.

Figure 3:
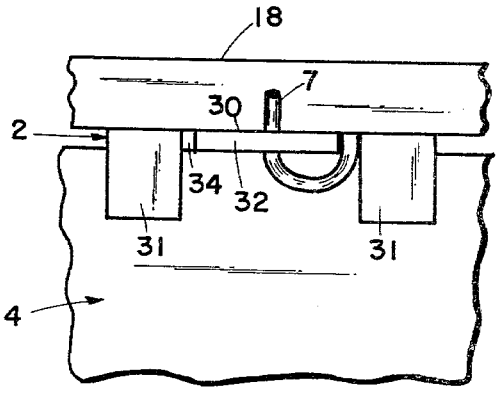
FIG. 3 is a side elevational view of that portion of the dispenser extending from the toilet tank.

Bracket 2 is shaped to hang container 3 from the upper edge 17 of toilet 15, at a location adjacent the sidewall 16 of tank 4. In the example illustrated in FIGS. 1–3, bracket 2 is generally Z-shaped with a yoke-like base plate 26 having a pair of prongs or fingers 27 which are spaced apart to be received in the aerosol container rim groove 23 and securely interconnect container 3 and bracket 2 with a snap lock. The end 28 of each prong 27 is arcuately shaped to facilitate insertion of prongs 27 into canister rim groove 23.

Base plate 26 has a length sized in accordance with the diameter of container 3, so that the container is retained in a substantially vertical orientation, spaced slightly from the interior surface of the adjacent toilet tank sidewall 16. The medial portion 29 of mounting bracket 2 is oriented substantially perpendicular with base plate 26, and extends upwardly from the end thereof a distance sufficient to permit flexible tube 7 and actuator arm 5 to clear toilet tank top 18. Medial bracket portion 29 abuts the interior surface of tank sidewall 16 to securely retain container 3 in a substantially vertical orientation.

Bracket 3 also includes an upper plate 30 extending substantially perpendicularly and outwardly from medial bracket portion 29. Upper plate 30 is shaped to engage the upper edge 17 of toilet tank sidewall 16, and a tab 31 is deformed downwardly to form a U-shaped catch or clip which securely holds aerosol can 3 in place with respect to tank 4. In this example, upper plate 30 includes two tabs 31 (FIG. 3) positioned on the left and right-hand sides of the bracket upper plate 30. The center portion 32 of upper plate 30 extends outwardly a spaced apart distance from the exterior surface of tank sidewall 16, and includes a vertically disposed aperture 33 therethrough adjacent the free end of bracket 2, and is sized to receive and retain the free end of flexible tube 7 therein. Bracket upper plate 30 has a thickness which is substantially commensurate with the outside diameter of flexible tube 7, such that tube 7 is threaded through one of the apertures or slots 32 formed between the upper plate tabs 31 and center portion 32, thereby preventing the tube from being pinched between the toilet top 18 and upper tank edge 17.

Bracket 3 is preferably constructed of a deformable, corrosion-resistant material, such as aluminum, chrome-plated sheet metal, or the like. Preferably, tabs 31 would be manufactured planar with bracket plate 32, and then manually bent over the upper edge 17 of toilet tank 4 by the installer. In this manner, bracket 2 may be securely attached to various types of toilet tanks, and accommodate different sidewall thicknesses. The lower rim of tank top 18 abuts the upper surface of bracket plate 32, so that the weight of the tank top holds the entire dispenser 1 down in place in the event that container 3 is, or must be positioned in the toilet tank at a depth at which buoyant forces act on container 3, and tend to lift the dispenser upwardly out of position.

With reference to FIG. 4, actuator arm 5 includes a cylindrically shaped inner end 38 having a passageway extending axially therethrough defined by upper and lower apertures 39 and 40 respectively. Upper aperture 39 is sized to receive and frictionally retain one end of flexible tube 7 therein, and lower aperture 40 is sized to receive and frictionally retain the upper end of valve stem 6 therein. In this manner, when the aerosol container valve is open, spray is emitted from the outlet of valve stem 6 passes through passageways 39 and 40 in arm end 38, into flexible tube 7, and out into the air surrounding toilet 15.

Actuator arm 5 extends generally laterally and perpendicularly from cylindrical end 38, and includes lateral ribs or stiffeners 41 molded integrally on both sides of the arm. The outer or free end 42 of arm 5 includes a plurality of spaced, irregularities or detents 43 for varying the location at which pull rod 8 is attached to arm 5. In this example, detents 43 include regularly spaced, rounded notches positioned along the upper edge 44 of arm 5.

Actuator arm 5 is rigid, and preferably integrally molded in one piece from a suitable non-corrosive material, such as a synthetic resin like polyethylene or the like. The free end 42 of arm 5 has a substantially rectangular transverse cross-sectional shape, wherein the major axis extends vertically for additional rigidity. The free end 42 of arm 5 is preferably tapered to facilitate attachment of pull rod 8, as described below, and an integrally molded, triangular truss portion 45 of arm 5 adds extra stiffness.

With reference to FIG. 5, pull rod 8 includes a hook-like upper end 48 which is adapted to be pivotally suspended from the free end 42 of actuator arm 5. In this example, rod end 48 is substantially flat, and includes a rectangular aperture 49 therethrough which forms a window or eye having a shape which mates with the actuator arm free end 42 and is telescopingly received thereover. The height of aperture or eye 49 is preferably slightly smaller than the distance between the lower edge 50 of arm 5 and the uppermost surface of detents 53, so that the upper end 48 of pull rod 8 is securely fastened to the actuator arm with a snap lock action. This connection permits arm 5 to pivot while pull rod 8 maintains a substantially vertical orientation. Pull rod 8 had a medial stem portion 52 which extends downwardly from upper end 48, and includes an X-shaped transverse cross-sectional shape formed by perpendicular stiffening ribs 53 to provide the same with additional strength and rigidity.

Valve 9 (FIG. 1) is fixedly attached to the lower, terminal end of pull rod 8, and in this example, has a semi-spherical shape which is adapted to seal with metering cup 10 even when the same are not perfectly aligned. Valve 9 is oriented coaxially with pull rod 8, and has aa solid body with slightly concave bottom 53. Pull rod 8 is preferably integrally formed of a non-corrosive material similar to that of actuator arm 7, such as a rigid plastic or the like, and has a length, which is conjunction with bracket 2 and metering cup 10, insures that cup 10 is substantially submerged when tank 4 is full, and lip 61 is above the water level when the water in the tank has fully receded during the flush cycle.

Metering cup 10 is generally bell-shaped, with an open lower end 54 defined by free edge 55, and a substantially closed upper end 56 in which valve seat 11 is disposed. The illustrated cup 10 has a generally frustoconical shape with a sleeve 57 molded integrally with the cup upper end 56. Sleeve 57 forms an aperture or passageway 58 which communicates with the interior 59 of cup 10. Sleeve 57 has a substantially cylindrical shape, coaxial with cup 10, is large enough to permit flat rod end 48 to pass therethrough for assembly, and tapers arcuately at transition area 60 in the nature of a bell into cup upper end 56. Valve seat 11 is formed by the interior surface of transition area 60, and assumes substantially line contact with the exterior surface of hemispherical valve 9.

Pull rod 8 normally assumes a substantially coaxial relationship with metering cup 10, as illustrated in FIG. 1. However, the inside diameter of sleeve 58 is substantially larger than the outer dimension of stem 51, such that the surface tension of the water cannot form a water film which prevents air from escaping during cup refill. Further, the aperture formed between sleeve 58 and stem 51 permits substantial misalignment between pull rod 8 and metering cup 10 without affecting the integrity of the seal formed between valve 9 and seat 11.

Metering cup 10 has an interior cavity size which is selected to be capable of retaining a quantity of water therein having sufficient weight to fully deflect actuator arm 5 laterally and open the valve. Yet cup 10 itself, arm 5 and pull rod 8 are not sufficiently heavy in and of themselves to deflect and open valve 6. In this example, the interior 59 of metering cup 10 has a diameter of approximately 2.0–2.2 inches, a height of approximately 1.9–2.0 inches, and holds approximately two to four fluid ounces of water. The free, lower edge 55 of the illustrated metering cup 10 includes an outwardly flared flange or lip 61 which facilitates the sudden release of the trapped water in cup 10, as described below. Like actuator arm 5 and pull rod 8, metering cup 10 is preferably integrally constructed in one piece from a noncorrosive material such as polyethylene or the like.

In use, dispenser 1 is assembled with aerosol container 3 of room freshener or the like, by first inserting one end of flexible tube 7 into the upper aperture 39 of actuator arm 5. If a spray cap (not shown) is located on valve stem 6, the same is removed by simply pulling the cap upwardly off of the valve stem. Actuator arm 5 with assembled tube 7 is then converged with the aerosol container 3, and the upper end of the container valve stem 6 is inserted telescopingly into the lower aperture 40. Preferably, this operation is accomplished by setting the aerosol can 3 on a stationary surface, and pressing the arm end 38 onto the valve stem. During this operation, the aerosol container valve will open momentarily, such that the free end of flexible tube 7 should be directed away from the user and/or other objects which might be damaged if the aerosol spray were to contact the same.

The upper end 48 of pull rod 8 is snapped over the free end 42 of arm 5, and positioned in a preselected one of the detents 43. The rim 22 of aerosol container 3 is then snapped into position between the prongs 27 of bracket 2. The toilet top 18 is then removed from the toilet, and the dispenser and aerosol container are lowered into the interior of toilet tank 4, until the upper plate 30 of bracket 2 engages the upper edge 17 of the tank. Tabs 31 are then bent downwardly over the edge of toilet tank 4, thereby securely mounting the dispenser 1 and aerosol canister 3 in the interior of toilet tank 4. Dispenser 1 is pivoted horizontally with actuator arm 5 until the same is free from all interference with either the walls of the tank and/or the flushing mechanism in the tank. The free end of flexible tube 7 is then positioned in one of the gaps or slots 34 formed between tabs 31 and the central portion 32 of bracket upper plate 30, and then threaded from the bottom of plate 30 through aperture 33. The free end of flexible tube 7 is preferably oriented in a direction away from the wall or other objects which might be stained if the spray were to impinge directly on it. The frictional reception of the tube free end in aperture 33 retains the tube securely in place. Tank top 18 is then replaced on the toilet, and the lower edge of flange 63 abuts bracket plate 32, such that the weight of the top assists in holding the dispenser down in place.

In operation, when the toilet tank is full of water, as illustrated in FIG. 1, the resilient return spring of valve stem 6 is sufficient to overcome the torque applied thereto by the weight of arm 5, and the unbuoyed portion of pull rod 8, so as to retain actuator arm 5 in a substantially horizontal orientation. In this example, metering cup 10 is sufficiently buoyant that it floats on the surface of the water at a height substantially level with the upper end 56 of cup 10. Since cup 10 and the lower portion of pull rod 8 are submerged and buoyant when tank 4 is full, they apply very little, if any force to the outer end of arm 5. As a result, dispenser valve stem 6 is normally unloaded, and will not become set or bent in a manner which can cause valve leakage or other malfunctions. When the toilet is flushed, the water level in tank 4 recedes, and as shown in FIG. 6, water is trapped in the interior 59 of metering cup 10 as valve 9 seats securely against seat 11 to prevent the introduction of air which would allow the trapped water to escape. The weight of the water trapped in cup 10 applies a downward force to the outer end 42 of arm 5, and the buoyant forces applied to the metering cup 10 and the lower end of pull rod 8 by the water is removed. Hence, the combination of the unbuoyed weight of the metering cup 10 and the water trapped in the cup provides substantial weight, which pivots arm 5 downwardly, thereby pivoting valve stem 6 into an open position, such that the air freshener is propelled from container 3 through flexible tube 7 into the room in which the toilet is located, as shown in FIG. 6. The weight of the water trapped in cup 10 also pulls valve head 9 securely against valve seat 11 to form a substantially airtight seal.

As best illustrated in FIG. 7, when the water level 12 in tank 4 descends below the lip 61 of metering cup 10, the seal between the water trapped in the interior of the cup and the water in the tank is broken. The water trapped in cup 10 is then released suddenly into toilet tank 4, thereby quickly removing the weight applied to actuator arm 5, and permitting the valve stem return spring to swiftly pivot the actuator arm upwardly into the closed position. This quick and substantially total release of the weight on actuator arm 5 helps to prevent the aerosol valve from becoming stuck in a partially open position, as is often experienced when the valve actuating weight is removed slowly.

With reference to FIG. 8, as the water in the toilet tank 4 rises, metering cup 10 tends to float on the surface of the water, thereby raising the cup and lifting valve seat 11 off of valve 9, which permits the air trapped in cup 10 to escape through sleeve 57. As the air trapped in cup 10 is vented or exhausted, water flows into cup 10 through the open bottom end 54 to assume a level substantially equal to water line 12. Preferably, toilet tank 4 is ultimately filled to a level wherein metering cup 10 is floating and substantially submerged. If the water fills in tank 4 to a height above valve 9, as illustrated in FIG. 1, cup 10 floats upwardly along pull rod 8. Pull rod 8 is also buoyant, so that it tends to rise and tilt slightly as the water level 12 exceeds the height of valve 9. At this water level, the snap lock connection of pull rod end 40 in the arm detents 43 securely retains pull rod 8 in a generally vertical orientation.

To adjust the amount of air freshener spray dispersed during each cycle, the user simply moves pull rod 8 laterally with respect to actuator arm 5. If less spray is desired, pull rod 8 is moved to the left (as viewed in FIG. 1) so that the seal between the descending water line 12 and the bottom of cup 55 is broken sooner, and the lever arm at which the valve energizing forces are applied is shortened. In like manner, to obtain more spray, pull rod 8 is moved toward the outer, free end of actuator arm 5.

Dispenser 1 is also adapted for use with conventional pump-type air freshener spray mechanisms (not shown), of the type having a reciprocating pump neck. Resilient return means, such as a spring normally retains the pump neck in a fully extended position, and the neck is depressed to pump liquid air freshener from the container. In such uses, actuator arm 5 may be attached to the pump neck in a manner similar to the above described aerosol spray arrangement. Alternatively, actuator arm 5 may be hingedly mounted on bracket 2, so that arm 5 abuts the pump neck and reciprocates the pump neck when the arm rotates. When the toilet is flushed, the force applied by metering cup 10 on arm 5 depresses the pump neck and forces a spray of air freshener into the room through flexible tube 7. When the water level in tank 4 recedes below the lower lip 61 of cup 10, the pumping force is removed from air 5, and the return spring in the pump extends the pump neck to its initial position.

Dispenser 1 can also be used with other types of mechanical pumps, such as a pump having a neck which is pivoted in a substantially vertical plane to draw air freshener from the container. Hence, it is apparent that the present invention can be used with any type of dispenser which includes a neck which is moved relative to the container to expel air freshener into the air.

In aerosol spray uses, the relatively high torque applied to valve stem 6 by the weight of the unbuoyed portion of metering cup 10 and the water trapped therein serves to reliably and fully open the aerosol valve so that air freshener is sprayed into the room each and every time the toilet is flushed. The sudden release of the trapped water in metering cup 10 at the end of the flush cycle permits valve stem 6 to return quickly and immediately close the valve, so as to alleviate slow leaks. The detented arm 5 in conjunction with the windowed upper end 48 of pull rod 8 provides a quick and easy means to adjust the amount of air freshener dispensed with each toilet flush. The ability of actuator arm 5 and the suspended pull rod and metering cup to be rotated laterally with respect to aerosol container 3 prevents interference between the dispenser and the working parts of the toilet. Dispenser 1 is quite versatile, and can be used with either aerosol or pump-type sprays.

In the foregoing description, it will be readily appreciated by those skilled in the art that many modifications may be made to the invention without departing from the concepts disclosed herein. Such modifications are to be considered as included in the following claims unless these claims by their language expressly state otherwise.

The embodiments of the invention in which and exclusive property or privilege is claimed are defined as follows.

1. An automatic actuator for actuating the product release mechanism of a product container mounted within a toilet tank, said automatic actuator comprising:

an actuator arm having one end thereof adapted for operable connection to the product release mechanism of the container;

a pull rod having one end thereof suspended from the other end of said actuator arm, and including a valve head connected with the other end of said pull rod; and a cup having an open lower end, and a closed upper end with a valve seat defining an opening therein in which said valve head is matingly received and selectively reciprocates, whereby as the water level in the toilet tank descends, said cup and valve seat are pulled sealingly against said valve head by the weight of the water in the unbuoyed portion of the cup, which weight moves the product release mechanism to dispense product from the container, and whereby when the descending water level drops below said cup lower end, the water trapped in said cup is released suddenly into the toilet tank, thereby quickly releasing the weight applied to said actuator arm and permitting the product release mechanism to return to its initial position, and whereby as the water level rises in the tank, air is displaced from said cup by lifting said cup off of said valve head and exhausting the air through said opening defined by said valve seat so that said cup refills at least partially with water.

2. An actuator as set forth in claim 1, wherein:

said valve head has a semi-spherical shape to facilitate sealing with said seat.

3. The actuator of claim 1 or 2, wherein:

said pull rod extends through said opening defined by said valve seat and is smaller in cross section than said opening; and said valve head is positioned within said cup.

4. An actuator as set forth in claim 3, including:

means for releasably connecting said pull rod one end at different locations along said actuator arm for varying the amount of product dispensed with each toilet flush.

5. An actuator as set forth in claim 4, wherein:

said pull rod is pivotally suspended from said actuator arm.

6. An actuator as set forth in claim 5, wherein:

said releasable connecting means comprises detents along an upper edge of said actuator arm other end in which a hook-shaped portion of said pull rod one end is releasably retained.

7. The automatic actuator of claim 5 in which said cup, actuator arm and pull rod are made of a material sufficiently light that when water empties from said cup, said cup, arm and rod do not prevent a normally closed product release mechanism of a container from returning to its normally closed position.

8. The automatic actuator of claim 4 in which said cup, actuator arm and pull rod are made of a material sufficiently light that when water empties from said cup, said cup, arm and rod do not prevent a normally closed product release mechanism of a container from returning to its normally closed position.

9. The automatic actuator of claim 3 in which said cup, actuator arm and pull rod are made of a material sufficiently light that when water empties from said cup, said cup, arm and rod do not prevent a normally closed product release mechanism of a container from returning to its normally closed position.

10. The automatic actuator of claim 1 in which said cup, actuator arm and pull rod are made of a material sufficiently light that when water empties from said cup, said cup, arm and rod do not prevent a normally closed product release mechanism of a container from returning to its normally closed position.

11. An actuator as set forth in claim 1, wherein:

said pull rod is pivotally suspended from said actuator arm.

12. An actuator as set forth in claim 1, including:

means for releasably connecting said pull rod one end at different locations along said actuator for varying the amount of air freshener dispensed with each toilet flush.

13. An actuator as set forth in claim 1, which includes:

means for releasably connecting said pull rod one end at different locations along said actuator arm for varying the amount of air freshener dispensed with each toilet flush.

14. An actuator as set forth in claim 1, wherein:

said actuator arm one end includes first and second aligned, interconnected sleeves on opposite sides thereof; said first sleeve being shaped to telescopingly receive the outlet end of the aerosol valve stem therein, and said second sleeve being shaped to telescopingly receive one end of said flexible tube therein.

15. An automatic actuator for an aerosol air freshener container or the like mounted in the interior of a flush toilet tank, with means for communicating the container dispenser valve outlet to the exterior of the tank, the aerosol container being of the type comprising a dispenser valve with a protruding stem which is pivoted laterally to an open valve position, and includes an outlet and resilient return means for maintaining the dispenser valve in a normally closed position, said actuator comprising:

an actuator arm having one end thereof shaped for connection with the valve stem, and extending generally laterally thereof;

a pull rod having one end thereof pivotally suspended from the other end of said actuator arm;

a cup connected with the other end of said pull rod having an open lower end, and a closed upper end; and a cup valve disposed in said cup upper end, and having means for controlling the flow of water into and out of the interior of said cup; said cup valve having a normally closed position, and being opened by super ambient fluid pressure in said cup interior, whereby as the water level in the toilet tank rises, air trapped in said cup interior is exhausted through said cup valve and said cup is filled with water, such that the dispenser valve return means resiliently maintains said actuator arm in the closed aerosol valve position; and as the water level in the toilet tank descends, the weight of the water trapped in the unbuoyed portion of said cup overcomes the dispenser valve return means and pivots said actuator arm into the open aerosol valve position until the descending water level drops below said cup lower end, at which point the water trapped in said cup is released suddenly into the toilet tank thereby quickly removing the weight applied to said actuator arm and permitting the dispenser valve return means to swiftly pivot said actuator back into the closed aerosol valve position.

16. An actuator as set forth in claim 15, including:

means for releasably connecting said pull rod one end at different locations along said actuator arm for varying the amount of air freshener dispensed with each toilet flush.

17. The actuator as set forth in claim 15 or 16, wherein:

said actuator arm one end includes first and second aligned, interconnected apertures on opposite sides thereof, a first aperture adapted to receive and frictionally retain said valve stem outlet; and a second aperture being adapted to receive and frictionally retain said communicating means.

18. The automatic actuator of claim 15 or 16 in which said cup, actuator arm and pull rod are made of a material sufficiently light that when water empties from said cup, said cup, arm and rod do not prevent a normally closed product release mechanism of a container from returning to its normally closed position.

* * * * *

UNITED STATES PATENT AND TRADEMARK OFFICE

CERTIFICATE OF CORRECTION

PATENT NO. : 4,358,860

DATED : November 16, 1982

INVENTOR(S) : David R. Church

It is certified that error appears in the above-identified patent and that said Letters Patent is hereby corrected as shown below:

Column 5, line 13:

"had" should be --has--

Column 5, line 23:

"aa" should be --a--

Column 5, line 26:

"is" should be --in--

Column 8, line 1:

"air" should be --arm--

Column 10, line 55:

after "aperture" insert --being--

Signed and Sealed this

*Twentieth* Day of *September 1983*

[SEAL]

*Attest:*

*Attesting Officer*

GERALD J. MOSSINGHOFF

*Commissioner of Patents and Trademarks*